US011376843B2

(12) United States Patent
Khalate et al.

(10) Patent No.: US 11,376,843 B2
(45) Date of Patent: Jul. 5, 2022

(54) METHOD OF FAST NOZZLE FAILURE DETECTION

(71) Applicant: Canon Production Printing Holding B.V., Venlo (NL)

(72) Inventors: Amol A. Khalate, Venlo (NL); Koen Joan Klein Koerkamp, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 45 days.

(21) Appl. No.: 17/036,314

(22) Filed: Sep. 29, 2020

(65) Prior Publication Data

US 2021/0008873 A1 Jan. 14, 2021

Related U.S. Application Data

(63) Continuation of application No. PCT/EP2019/060233, filed on Apr. 19, 2019.

(30) Foreign Application Priority Data

Apr. 23, 2018 (EP) ..... 18168796

(51) Int. Cl.
*B41J 2/045* (2006.01)
*B41J 2/14* (2006.01)

(52) U.S. Cl.
CPC ..... *B41J 2/0451* (2013.01); *B41J 2/04596* (2013.01); *B41J 2/04581* (2013.01); *B41J 2002/14354* (2013.01)

(58) Field of Classification Search
CPC .. B41J 2/04558; B41J 2/04596; B41J 2/0451; B41J 2/2142; B41J 2/2139; B41J 2/16579
See application file for complete search history.

(56) References Cited

U.S. PATENT DOCUMENTS 10,144,215 B2 * 12/2018 Mihailovic ..... B41J 2/04586
2011/0285771 A1 * 11/2011 Shinkawa ..... B41J 2/16579 347/9

(Continued)

FOREIGN PATENT DOCUMENTS

EP 1 452 319 A1 9/2004
EP 2 008 823 A2 12/2008

(Continued)

OTHER PUBLICATIONS

International Search Report, issued in PCT/EP2019/060233, dated Jun. 11, 2019.

(Continued)

*Primary Examiner* — Lam S Nguyen
(74) *Attorney, Agent, or Firm* — Birch, Stewart, Kolasch & Birch, LLP

(57) ABSTRACT

In a method of nozzle failure detection in an ink jet printer having a plurality of ejection units including a nozzle and an associated liquid chamber with an electromechanical transducer, nozzle failure detection is performed, for each ejection unit, with a given minimum detection frequency. Each nozzle failure detection includes energizing the transducer with a waveform that does not lead to the ejection of a droplet but creates a pressure fluctuation that is sensitive to whether or not the ejection unit is in a malfunction state; measuring the pressure fluctuation in order to detect the malfunction state; defining a mask pattern that is independent of image contents to be printed; and when an image is being printed, performing the nozzle failure detection steps for each ejection unit at timings at which the respective nozzles are in pixel positions that belong to the mask pattern.

9 Claims, 4 Drawing Sheets

(56) References Cited

U.S. PATENT DOCUMENTS

| | | | | |
|---|---|---|---|---|
| 2012/0212529 | A1 | 8/2012 | Hayashi | |
| 2012/0229546 | A1* | 9/2012 | Okada | B41J 2/2142 347/14 |
| 2015/0091960 | A1* | 4/2015 | Nakazawa | B41J 2/04541 347/10 |
| 2017/0151775 | A1 | 6/2017 | Klein Koerkamp et al. | |
| 2017/0225454 | A1* | 8/2017 | Yoshida | B41J 2/17566 |

FOREIGN PATENT DOCUMENTS

| | | | |
|---|---|---|---|
| EP | 2 842 752 | A1 | 3/2015 |
| WO | WO 2016/113232 | A1 | 7/2016 |
| WO | WO 2017/125380 | A1 | 7/2017 |
| WO | WO 2017/144335 | A1 | 8/2017 |

OTHER PUBLICATIONS

Written Opinion of the International Searching Authority, issued in PCT/EP2019/060233, dated Jun. 11, 2019.

* cited by examiner

METHOD OF FAST NOZZLE FAILURE DETECTION

CROSS REFERENCE TO RELATED APPLICATIONS

This application is a Continuation of PCT International Application No. PCT/EP2019/060233, filed on Apr. 19, 2019, which claims priority under 35 U.S.C. 119(a) to patent application Ser. No. 18/168,796.3, filed in Europe on Apr. 23, 2018, all of which are hereby expressly incorporated by reference into the present application.

The invention relates to a method of nozzle failure detection in an ink jet printer having a plurality of ejection units each of which comprises a nozzle and an associated liquid chamber with an electromechanical transducer for energizing a pressure wave in the liquid chamber so as to expel an ink droplet from the nozzle, the method comprising steps of nozzle failure detection to be performed, for each ejection unit, with a given minimum detection frequency, wherein each nozzle failure detection step comprises:

energizing the transducer with a detection waveform that does not lead to the ejection of a droplet but creates a pressure fluctuation that is sensitive to whether or not the ejection unit is in a malfunction state; and measuring the pressure fluctuation in order to detect the malfunction state.

A known inkjet print head comprises a number of ejection units, wherein each ejection unit comprises a liquid chamber for holding an amount of liquid. Commonly, the liquid is an ink, such as a solvent-based or water-based ink, a hot-melt ink at an elevated temperature or a UV-curable ink, but the liquid may be any other kind of liquid. Other examples include liquids that need to be accurately dosed.

Each ejection unit of the inkjet print head further comprises an electromechanical transducer operatively coupled to the liquid chamber for generating a pressure wave in the liquid held in the liquid chamber. A well-known electromechanical transducer is a piezo-actuator, comprising two electrodes and a layer of piezo-electric material arranged therebetween. When an electric field is applied by application of a voltage over the electrodes, the piezo-material mechanically deforms and the deformation of the piezo-actuator generates the pressure wave in the liquid. Other kinds of electromechanical transducers are also known for use in an inkjet print head, such as an electrostatic actuator.

Each ejection unit further comprises a nozzle in fluid communication with the liquid chamber. If a suitable pressure wave is generated in the liquid in the liquid chamber, a droplet of the liquid is expelled through the nozzle. If the liquid is an ink, the droplet may impinge on a recording medium and form an image dot on the recording medium. A pattern of such image dots may form an image on the recording medium as well-known in the art.

A known disadvantage of the above-described inkjet print head is the susceptibility to malfunctioning of the ejection units. In particular, it is known that an air bubble may be entrained in the nozzle or in the liquid chamber. Such an air bubble changes the acoustics of the ejection unit and as a consequence a droplet may not be formed when the pressure wave is generated. Another known cause for malfunctioning is dirt particles (partly) blocking the nozzle. The presence of dirt does not only block the liquid flow, but also changes the acoustics.

It is well-known in the art to sense a residual pressure wave in the liquid. After the generation of a pressure wave, the acoustics of the ejection unit result in a residual pressure wave that damps over time. Sensing and analyzing this residual pressure wave provides detailed information on the acoustics of the ejection unit. A comparison between the acoustics derived from the residual pressure wave and the acoustics of an ejection unit in an operative state allows to derive the operating state of the ejection unit. Moreover, it is known to determine a cause for a malfunctioning state from the residual pressure wave, if a malfunction state is derived.

A disadvantage of the known method for detecting an operating state is the time needed for sensing the residual pressure wave and the time needed for analysis of the residual pressure wave. Due to this relatively long period needed for sensing and analyzing, it is not possible to perform the analysis for each ejection unit after each droplet ejection. Moreover, even if there would be sufficient time between consecutive droplet ejections, the computational power needed to analyze each ejection unit after each droplet ejection would be so high, that this would not be commercially feasible.

A method of the type defined in the opening paragraph has been disclosed in WO 2016/113232 A1. In this method, after generating a pressure wave in the liquid, the electromechanical transducer is actuated to suppress the residual pressure wave in the liquid. Such a suppression of the residual pressure wave is commonly also referred to as quenching. After quenching, an amplitude of the residual pressure wave in the liquid is sensed. Based on the sensed amplitude, it is determined that the ejection unit is either (i) in an operative state if the amplitude of the residual pressure wave is below a threshold or (ii) in a malfunctioning or at least failure-prone state if the amplitude of the residual pressure wave is above the threshold.

Quenching is known from the prior art for removing any residual pressure wave in an ejection unit in order to prepare the ejection unit for a next droplet ejection. A residual pressure wave affects a subsequently generated pressure wave and hence affects a subsequent droplet in size, speed, and/or any other property. Quenching is known to ensure droplet formation without influence from a previous droplet formation.

The method described in the cited document is based on the consideration that a quench pulse, i.e. an actuation pulse applied to the electromechanical transducer for quenching the residual pressure wave, is highly adapted to the residual pressure wave that normally remains after actuation in a well-functioning (operative) liquid chamber. The acoustics of the liquid chamber are known, and based on such known acoustics the quench pulse has been designed. Such a quench pulse is usually tuned with respect to timing and amplitude and often also with respect to a number of other parameters. If tuned correctly, only then a residual pressure wave with a very low amplitude remains. So, in general, any residual pressure wave remaining after the quench pulse should have a very low amplitude, as the quench pulse has been designed to do so.

If the acoustics of the liquid chamber change due to the presence of dirt particles or a gas (usually air) bubble or any other cause, the quench pulse will not be able to lower the amplitude of the residual pressure wave sufficiently. Under certain circumstances, the quench pulse may even increase the amplitude of the residual pressure wave.

Sensing an amplitude and merely evaluating the value of the amplitude by comparison with a (low) threshold takes a relatively short period of time and requires relatively little computational power. The pressure wave used for detecting the condition of the ejection unit may be such that a suitable residual pressure wave is generated, while no droplet is expelled (i.e. a non-ejecting pressure wave). Then, using a corresponding quench pulse, such residual pressure wave may be quenched and the method according may be carried out without expelling a droplet. Such embodiment allows to easily and quickly detect the operating state of an ejection unit, and the detection waveform may be fine-tuned so as to optimize the sensitivity of the residual pressure wave for the operative or malfuction condition of the ejection unit.

Thus, the method allows to verify the operating state of an ejection unit even during a print job, in particular between two droplets ejected during the print job, e.g. while a gap between two successive recording sheets passes the print head or in a time period in which the image contents of the image to be printed require that the ejection unit is silent.

In a multi-pass print process, it is generally sufficient if the occurrence of a nozzle failure is detected at some time at or before the end of a scan pass, because it is still possible to compensate for the nozzle failure i.e. to camouflage the visible artefact caused by the nozzle failure, by activating neighboring nozzles in a subsequent scan pass. In a single-pass process, however, it is important that a nozzle failure is detected as soon as possible after it has occurred, so that a failure compensation algorithm can be activated as soon as possible. A not compensated nozzle failure may result in a visible artefact which cannot be eliminated later.

It is therefore an object of the invention to provide a method of nozzle failure detection which permits to detect a nozzle failure already a short time after it has occurred.

In order to achieve this object, the method according to the invention comprises:

defining a mask pattern that is independent of image contents to be printed, said mask pattern defining positions of blank pixels on a dark background such that the blank pixels are distributed over the image area so finely that they are hardly perceptible to the human eye; and when an image is being printed, performing the nozzle failure detection steps for each ejection unit at timings at which the respective nozzles are on pixel positions that belong to the mask pattern.

The invention utilizes the method of fast nozzle failure detection (FFD) that has been described above for performing the failure detection steps "on the fly" while an image is being printed. Since no droplet can be ejected during the failure detection step, this detection step will itself produce an artefact, i.e. a blank pixel (white in case of black-and-white printing and a pixel with the wrong color in the case of color printing) in the printed image. However, since the failure detection can be accomplished in a very short time, the resulting artefact will extend only over a very small number of adjacent pixels. Ideally, the detection is so fast that only a single pixel position will be affected. Then, when the pixel positions that are affected by the failure detection steps are selected in accordance with the mask pattern, the artefact consists only of isolated blank pixels that are evenly distributed over the image area and are therefore practically imperceptible.

Indepedently of the image contents to be printed, the mask pattern can be defined such that each ejection unit is tested for possible nozzle failures with a certain minimum detection frequency so that the time delay between the occurrence of a nozzle failure and the detection of that failure will never exceed the period that corresponds to the maximum detection frequency. Then, once the nozzle failure has been detected, suitable counter-measures such as nozzle failure compensation and/or elimination of the nozzle failure may be performed, so that, even in a single-pass process, the artefacts produced by nozzle failures will be confined to relatively short pixel lines the length of which corresponds to the delay time between occurrence and detection of the nozzle failure.

Useful further developments of the invention are indicated in the dependent claims.

Additional failure detection steps may be performed for each ejection unit at pixel positions where, in view of the image contents to be printed, the unit is inactive anyway. This will increase the average detection frequency even further.

In one embodiment, a nozzle failure compensation algorithm is called-up immediately when a nozzle failure for a particular ejection unit has been detected.

It will be observed that the very fast nozzle failure detection steps discussed above can in most cases provide only a "yes" or "no" answer to the question whether the ejection unit is in a malfunction state. In order to obtain more detailed information on the nature and cause of malfunction, a more thorough and time-consuming analysis of the residual pressure wave would be necessary. As long as the exact nature of the malfunction is not yet known, it cannot be excluded that the malfunction is due to a partial clogging of the nozzle, resulting in the ejection of a droplet with a certain aberration. Since this may cause an artefact that would be difficult to compensate, it may be preferred to disable the ejection unit completely and to rely only upon the failure compensation in order to obtain a predictable result.

Meanwhile, one or more non-printing pulses may be applied to the transducer of the malfunctioning ejection unit in order to analyze the residual pressure wave in greater detail so as to identify the nature of the malfunction. Then, suitable maintenance operations such as purging the nozzle or wiping the nozzle face of the print head may be initiated on the next occasion, e.g. at the end of the current scan pass or when a printed page has been completed.

Thanks to high sensitivity of the fast failure detection step, it is even possible to detect events in which a very small air bubble has been drawn into the nozzle, the air bubble being still too small to cause a malfunction. However, if the ejection unit is kept operating in such a case, the air bubble tends to grow and eventually cause a malfunction. When the more detailed analysis of the residual wave(s) reveals that such a situation has occurred, the ejection unit may be disabled temporarily, and it may be attempted to cause the air bubble to shrink and eventually disappear by energizing the transducer with wave forms that are specifically shaped for that purpose. In this way, the invention permits to some extent even a nozzle failure preemption.

In color printing, the mask patterns used for the different color components may be identical or differ from one another. In the latter case, the blank pixels will not be white but show only a color deviation.

Embodiment examples will now be described in conjunction with the drawings, wherein.

Figure 1:
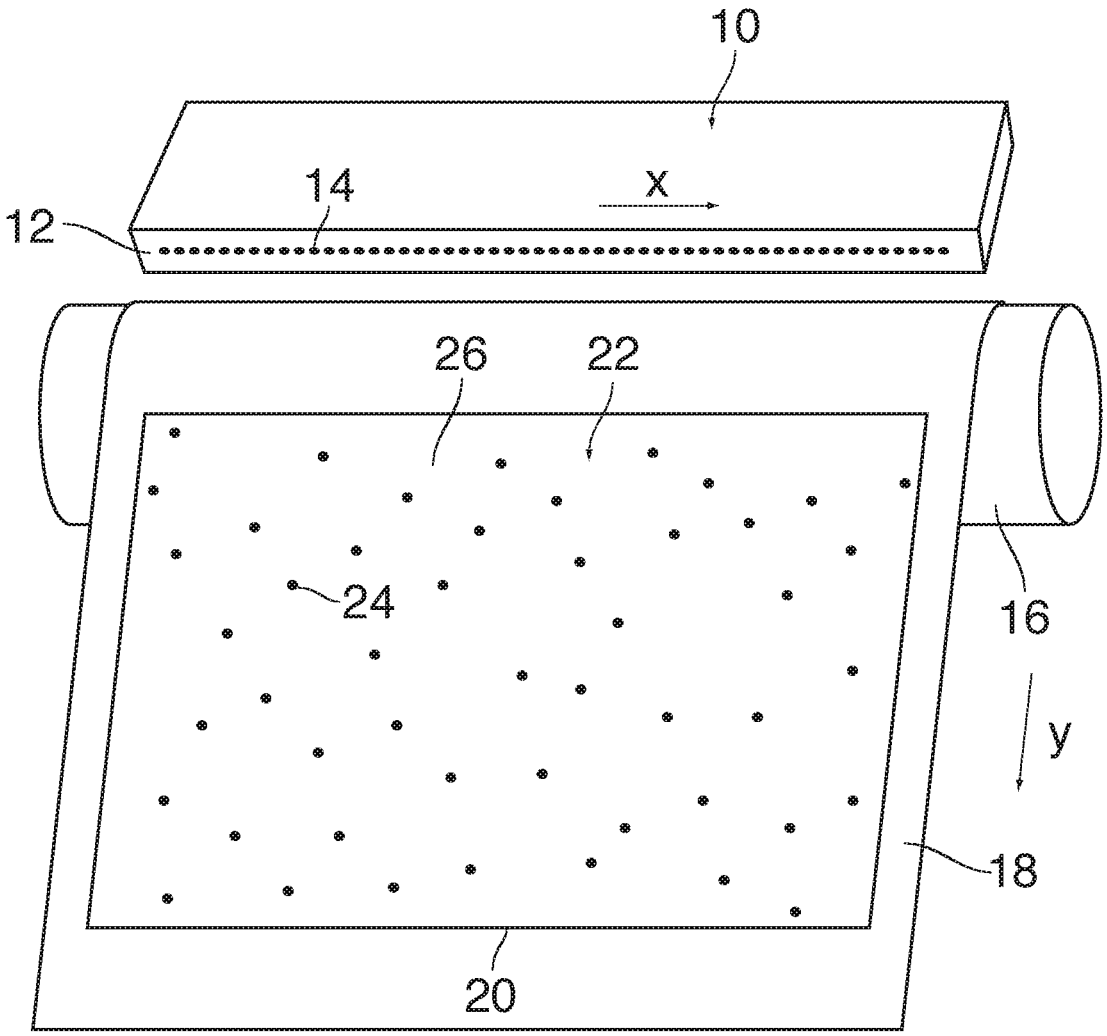
FIG. 1 is a schematic view of an ink jet printer and a print process in which a method according to the invention is employed.

FIG. 1 shows a page-wide ink jet print head 10 having a nozzle face 12 with a row of nozzles 14 facing a platen 16 and arranged to eject ink droplets onto a recording medium 18 that is passed over the platen 16 in order to form a printed image 20 on the recording medium.

The drawing does not show image contents of the image 20 but instead shows a symbolic representation of a mask pattern 22 that is used in a nozzle failure detection process. The mask pattern 22 can be imagined as a pattern of blank pixels 24 on a dark background 26. For reasons of reproducibility of the drawing, the mask pattern 22 has been shown inverted, i.e. the background 26 has been shown in white and the blank pixels 24 have been shown in black. The pixel positions of the blank pixels 24 appear to be randomly distributed over the area of the image 20 with uniform density, but the distribution of pixel positions is actually only pseudo-random and has been designed to assure that exactly one blank pixel 24 occurs in each pixel column that is printed with an associated one of the nozzles 14.

As will be explained in detail below, the mask pattern 22 controls the timings of nozzle failure detection steps to be performed for each of the nozzles 14. As the sheet 18 is advanced in a sub-scanning direction y and the nozzles 14 are energized to print successive pixel lines that extend in a main scanning direction x, a failure detection step for a given nozzle 14 is performed at the time when the blank pixel 24 that is located in the same pixel column as the nozzle 14 is aligned with the nozzle. When the failure detection step is performed, the nozzle cannot eject a droplet, so that the pixel 24 is left blank. The failure detection process is so fast that it can be completed within a single drop-on-demand period, i.e. before the next pixel in the column reaches the position of the nozzle 14, so that this nozzle is ready again for ejecting a next ink dot. In this way, the printed image 20 will be "pierced" by blank pixels 24 only at the pixel positions designated by the mask pattern 22.

In a printer with a typical resolution of, for example, 400 or 600 dpi, the size of the individual pixels will be so small that the blank pixels 24 are hardly visible with the naked eye, even on a dark background of the image. Of course, if a blank pixel 24 happens to be located in a white image area, it will not be visible at all.

It will be understood that, in a practical embodiment, the number of nozzles 14 is significantly larger than the number of nozzles shown in FIG. 1, and, accordingly, the size of the blank pixels 24 will be significantly smaller than in FIG. 1.

The mask pattern 22 extends over the entire width of the print head 10 in the main scanning direction x, but its dimension in the sub-scanning direction y may be smaller than the dimension of a page to be printed. Thus, the image 20 shown in FIG. 1 should be considered only as a tile of a complete printed image, and the image of an entire page will be composed of a plurality of successive tiles. The mask pattern 22 will be applied repetitively to each tile, so that a nozzle failure detection step will be performed once per tile for each of the nozzles 14. Consequently, the minimum detection frequency with which a failure detection step is performed for each individual nozzle is given by the speed of advance of the sheet 18 in the sub-scanning direction y, divided by the length of the mask pattern 22 in that direction y. Whenever a nozzle failure occurs during the print process, the time delay between the occurrence of the failure and the detection of the failure in the next failure detection step for that nozzle will never be larger than the inverse of the minimum detection frequency.

Figure 2:
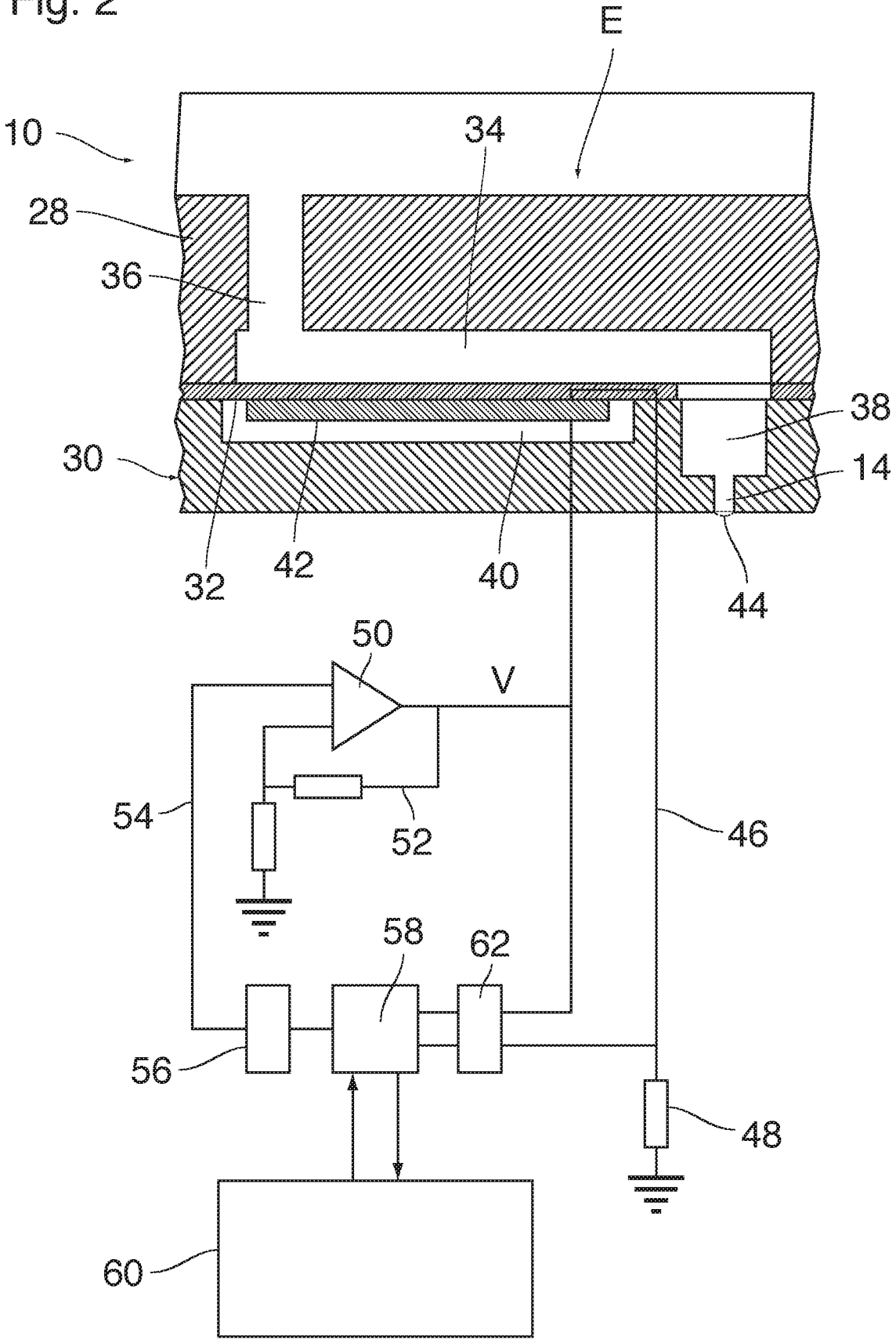
FIG. 2 is a cross-sectional view of mechanical parts of an ejection unit of a print head, together with an electronic circuit for controlling and monitoring the unit.

The failure detection step for an individual nozzle 14 will now explained in conjunction with FIG. 2 which shows a single ejection unit E of the print head 10. The print head is constituted by a wafer 28 and a support member 30 that are bonded to opposite sides of a thin flexible membrane 32.

A recess that forms a liquid chamber 34 is formed in the face of the wafer 10 that engages the membrane 32, e.g. the bottom face in FIG. 2. The liquid chamber 34 has an essentially rectangular shape. An end portion on the left side in FIG. 2 is connected to an ink supply line 36 that passes through the wafer 28 in thickness direction of the wafer and serves for supplying liquid ink to the liquid chamber 34.

An opposite end of the liquid chamber 34, on the right side in FIG. 2, is connected, through an opening in the membrane 32, to a chamber 38 that is formed in the support member 30 and opens out into the nozzle 14 that is formed in the bottom face of the support member.

Adjacent to the membrane 32 and separated from the chamber 38, the support member 30 forms another cavity 40 accommodating a piezoelectric transducer 42 that is bonded to the membrane 32.

The ink supply line 36, the liquid chamber 34, the chamber 38 and the nozzle 14 are filled with liquid ink. An ink supply system which has not been shown here keeps the pressure of this liquid ink slightly below the atmospheric pressure, e.g. at a relative pressure of −1000 Pa, so as to prevent the ink from leaking out through the nozzle 14. In the nozzle orifice, the liquid ink forms a meniscus 44.

The piezoelectric transducer 42 has electrodes that are connected to an electronic circuit that has been shown in the lower part of FIG. 2. In the example shown, one electrode of the transducer is grounded via a line 46 and a resistor 48. Another electrode of the transducer is connected to an output of an amplifier 50 that is feedback-controlled via a feedback network 52, so that a voltage V applied to the transducer will be proportional to a signal on an input line 54 of the amplifier. The signal on the input line 54 is generated by a D/A-converter 56 that receives a digital input from a local digital controller 58. The controller 58 is connected to a processor 60.

When an ink droplet is to be expelled from the nozzle 14, the processor 60 sends a command to the controller 58 which outputs a digital signal that causes the D/A-converter 56 and the amplifier 50 to apply a voltage pulse to the transducer 42. This voltage pulse causes the transducer to deform in a bending mode. More specifically, the transducer 42 is caused to flex downward, so that the membrane 32 which is bonded to the transducer 42 will also flex downward, thereby to increase the volume of the liquid chamber 34. As a consequence, additional ink will be sucked-in via the supply line 36. Then, when the voltage pulse falls off again, the membrane 32 will flex back into the original state, so that a positive acoustic pressure wave is generated in the liquid ink in the liquid chamber 34. This pressure wave propagates to the nozzle 14 and causes an ink droplet to be expelled.

The electrodes of the transducer 42 are also connected to an A/D converter 62 which measures a voltage drop across the transducer and also a voltage drop across the resistor 48 and thereby implicitly the current flowing through the transducer. Corresponding digital signals are forwarded to the controller 58 which can derive the impedance of the transducer 42 from these signals. The measured impedance is signalled to the processor 60 where the impedance signal is processed further, as will be described below.

The acoustic wave that has caused a droplet to be expelled from the nozzle 14 will be reflected (with phase reversal) at the open nozzle and will propagate back into the liquid chamber 34. Consequently, even after the droplet has been expelled, a gradually decaying acoustic pressure wave is still present in the duct 16, and the corresponding pressure fluctuations exert a bending stress onto the membrane 32 and the actuator 42. This mechanical strain on the piezoelectric transducer leads to a change in the impedance of the transducer, and this change can be measured with the electronic circuit described above. The measured impedance changes represent the pressure fluctuations of the acoustic wave and can therefore be used to derive a time-dependent function P(t) that describes these pressure fluctuations.

FIG. 3(A) shows a waveform 64 of a voltage signal V(t) that may be applied to the transducer 42. In a normal print mode, the waveform comprises an actuation pulse 66 causing the membrane 32 to deflect as described above and having an amplitude large enough to expel an ink droplet through the nozzle. The waveform further includes a quench pulse 68 that has opposite polarity in this example. The timing and the amplitude of the quench pulse 68 are selected such that it cancels (quenches) a residual pressure wave that oscillates in the ink chamber 34 and gradually decays after the droplet has been expelled. In the normal print mode, the quench pulse 68 assures that the pressure fluctuations in the liquid chamber 34 are practically reduced to zero at the time when another actuation pulse 66 is applied in the next drop-on-demand cycle.

Figure 3:
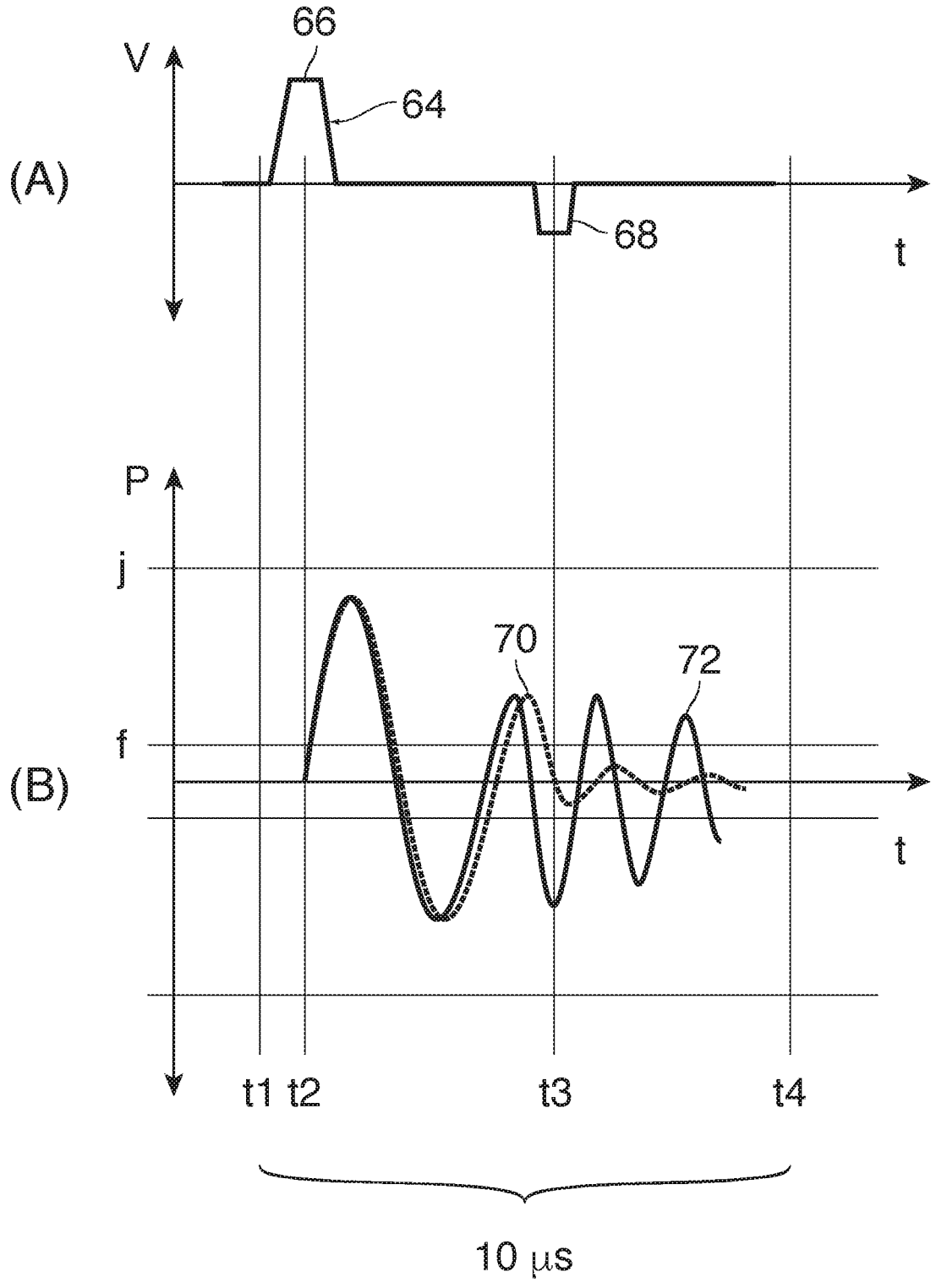
FIG. 3 shows time diagrams of a waveform applied to a transducer of the ejection unit and of pressure waves in an ink chamber of the ejection unit.

FIG. 3 shows one complete drop-on-demand cycle ranging from the time t1 to the time t4 and having a duration of 10 for example. The actuation pulse is applied at a time t2, and the quench pulse is applied at a time t3.

However, FIG. 3 does not actually illustrate a normal print operation in which an ink droplet is expelled, but instead applies to a nozzle failure detection step. Consequently, the waveform 64 shown in FIG. 3(A) is a detection waveform in which the amplitudes and timings (and optionally the shapes) of the actuation pulse 66 and the quench pulse 68 have been optimized for detection of nozzle failures rather than for expelling a droplet. In fact, the amplitude of the actuation pulse 66 shown in FIG. 3(A) is so small that no droplet will be expelled. Consequently, the energy of the actuation pulse is not transferred onto a droplet that is being created, but remains in the liquid in the ink chamber 34, which results in a "residual" pressure wave with a higher amplitude.

In FIG. 3(B), a curve 70 shown in dashed lines represents the pressure function P(t) for the residual pressure wave that is created in the failure detection step in case that the ejection unit is in an operating state, i.e. a droplet would have been expelled as desired, had the amplitude of the actuation pulse 66 been large enough. The timing and amplitude of the quench pulse 68 have been designed such that the residual pressure wave shown by the curve 70 is cancelled almost completely by destructive interference so that, in FIG. 3(B), the amplitude of the pressure wave sharply decreases at the time t3.

On the other hand, if the ejection unit E is in any kind of malfunction state, e.g. a state in which the nozzle 14 is partly or completely clogged or a state in which an air bubble is present in the nozzle or in the chamber 38 or in the liquid chamber 34 or the ink supply duct 36, the acoustics, i.e. the reflection and transmission behaviour of the acoustic wave will be changed such that the timing and amplitude of the quench pulse 68 is no longer tuned to destructive interference with the residual pressure wave and fails to suppress this pressure wave efficiently or even boosts the residual pressure wave by constructive interference, as has been illustrated by a solid curve 72 in FIG. 3(B). Consequently, the amplitude of the pressure wave represented by the curve 72 is significantly larger in the time interval between t3 and t4.

The malfunction state of the ejection unit can therefore be detected very easily and within a short time simply by checking whether the amplitude of the pressure wave between the times t3 and t4 is above a certain threshold f. If that is the case, it can be decided that the ejection unit is in a malfunction state, although it cannot yet be determined in what kind of malfunction state the unit is in. On the other hand, if the amplitude remains below the threshold f, it can be concluded that the ejection unit is in an operating state.

It will be appreciated that this decision can be made within an extremely short time, even within a single drop-on-demand period of the print head.

As has further been shown in FIG. 3(B), regardless of whether the unit is in a malfunction state or an operating state, the amplitude of the pressure wave remains always below a threshold j which is a threshold above which an ink droplet would be jetted-out. Consequently, no pixel can be printed with the ejection unit E in the drop-on-demand period between the times t1 and t4 shown in FIG. 3(B) and, consequently, a blank pixel 24 will be formed in the printed image.

Figure 4:
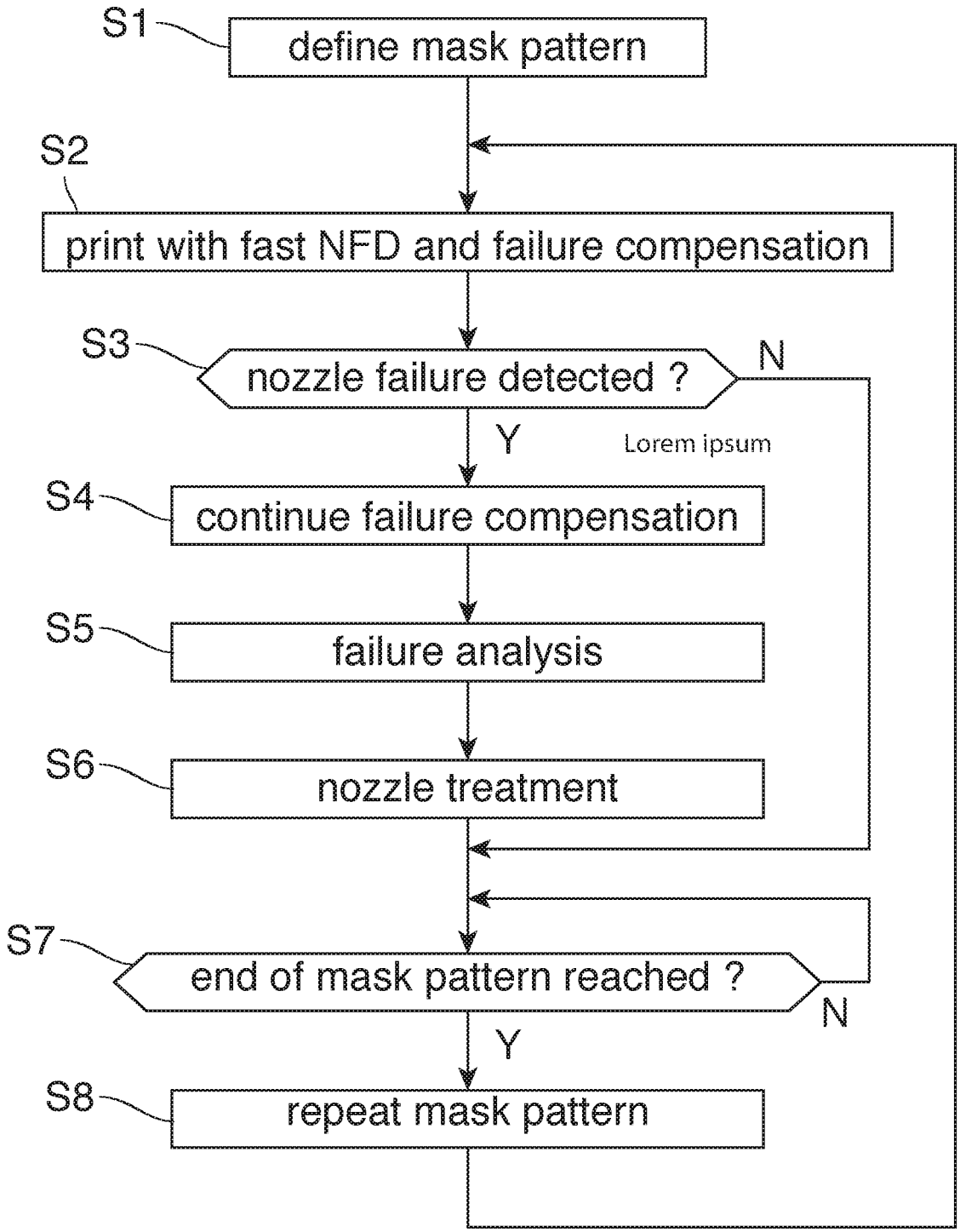
FIG. 4 is a flow diagram illustrating essential steps of a method according to the invention.

Essential steps of a print process with nozzle failure detection in accordance with the principles of the invention have been summarized in a flow diagram in FIG. 4.

In step S1, the mask pattern 22 is defined such that the minimum detection frequency determined by the pattern matches the quality requirements for the print job.

In step S2, the image 20 or several images or tiles are printed on the media sheet 18 and the fast nozzle failure detection steps as described in conjunction with FIGS. 2 and 3 are performed for each nozzle 14 as soon as it reaches a pixel position of a blank pixel 24. Since it is known in advance that no ink dot will be printed at that position, a failure compensation routine may be activated for that particular pixel position in order to further reduce the visibility of the blank pixel 24. For example, the volume of the ink droplets for the neighbouring pixel positions (in neighbouring pixel columns and also in the same column but preceding and following the blank pixel 28) may be increased by increasing the amplitude of the respective actuation pulses 66.

In step S3, it is checked whether a nozzle failure has been detected for any of the nozzles 14.

As soon as a nozzle failure has been detected, the malfunctioning nozzle is switched off in step S4 and failure compensation is continued for the pixels in the neighbouring pixel columns.

Then, in step S5, a detailed failure analysis is performed for the malfunctioning ejection unit in order to further characterize the nature of the malfunction. To that end, the transducer of the ejection unit is energized with a waveform having an activation pulse 66 too small to eject a droplet. A subsequent quench pulse 68 may be included or omitted and the pressure wave decaying in the ink chamber 34 will be analysed over an extended period of time in order to identify the type of nozzle failure that has occurred.

Then, depending upon the result of the failure analysis in step S5, a nozzle treatment may optionally be performed in step S6 in order to return the nozzle into the operating state (e.g. by wiping the nozzle face 12 or by purging the nozzle in a time gap between two sequent pages to be printed).

In step S7, it is checked whether the end of the mask pattern 22 has been reached. If that is the case (Y), the mask pattern is repeated in step S8, so that the next tile or image 20 can be printed and fast nozzle failure detection can be continued by looping back to step S2.

If no nozzle failure is detected in step S3 (M), the steps S4 to S6 are skipped.

It will be understood that the step S3 is performed whenever one of the nozzles 14 has reached a pixel position of one of the blank pixels 28 in the mask pattern. Consequently, there may be cases where two or more nozzle failures are detected, and the steps S4 to S6 are then performed for each of the malfunctioning nozzles.

The invention claimed is:

1. A method of nozzle failure detection in an ink jet printer having a plurality of ejection units each of which comprises a nozzle and an associated liquid chamber with an electromechanical transducer for energizing a pressure wave in the liquid chamber so as to expel an ink droplet from the nozzle, the method comprising steps of nozzle failure detection to be performed, for each ejection unit, with a given minimum detection frequency, wherein each nozzle failure detection step comprises:

energizing the transducer with a waveform that does not lead to the ejection of a droplet but creates a pressure fluctuation that is sensitive to whether or not the ejection unit is in a malfunction state;

measuring the pressure fluctuation in order to detect the malfunction state, defining a mask pattern that is independent of image contents to be printed, said mask pattern defining positions of blank pixels on a dark background such that the blank pixels are distributed over an area of an image so finely that they are hardly perceptible to the human eye; and when an image is being printed, performing the nozzle failure detection steps for each ejection unit at timings at which the respective nozzles are in pixel positions that belong to the mask pattern.

2. The method according to claim 1, wherein the mask pattern is repeatedly applied to successive tiles of an image to be printed.

3. The method according to claim 1, wherein the detection waveform includes an actuating pulse followed by a quench pulse that is designed to suppress a residual pressure fluctuation in the ink chamber only if the ejection unit is in an operating state, and the malfunction state is detected by comparing an amplitude of the residual pressure fluctuation after the quench pulse to a threshold.

4. The method according to claim 1, wherein the nozzle failure detection step for an individual nozzle is performed within a time interval (t1-t4) which has a duration not larger than a drop-on-demand period of the printer.

5. The method according to claim 1, wherein, when a malfunction state has been detected for any nozzle, a nozzle failure compensation algorithm is activated for that nozzle and is kept active as long as the nozzle failure persists.

6. The method according to claim 5, wherein, when a malfunction state has been detected for a particular nozzle, another nozzle failure detection process is performed for that nozzle in order to further characterize the nature of the malfunction and, when and if the nature of the malfunction has been identified, a maintenance step is performed for removing the malfunction.

7. The method according to claim 1, wherein, when a malfunction state of a particular ejection unit has been detected, that detection unit is switched off.

8. The method according to claim 7, wherein, when a malfunction state has been detected for a particular nozzle, another nozzle failure detection process is performed for that nozzle in order to further characterize the nature of the malfunction and, when and if the nature of the malfunction has been identified, a maintenance step is performed for removing the malfunction.

9. The method according to claim 1, wherein a nozzle failure compensation algorithm is performed for the pixel positions of the blank pixels.

* * * * *